US005857007A

United States Patent [19]

Haq

[11] Patent Number: 5,857,007

[45] Date of Patent: Jan. 5, 1999

[54] DAS HOUSING WITH ENHANCED HEAT TRANSFER CAPABILITY FOR CT IMAGING SYSTEM

[75] Inventor: Nadeem Haq, Milwaukee, Wis.

[73] Assignee: General Electric Company, Milwaukee, Wis.

[21] Appl. No.: 923,064

[22] Filed: Sep. 3, 1997

[51] Int. Cl.[6] ..... H05G 1/64

[52] U.S. Cl. ..... 378/19; 378/4

[58] Field of Search ..... 378/19, 4

[56] References Cited

U.S. PATENT DOCUMENTS 4,831,639 5/1989 Harke ..... 378/19

4,845,731 7/1989 Vidmar et al. ..... 378/19 X

*Primary Examiner*—David P. Porta

*Attorney, Agent, or Firm*—James O. Skarsten; Phyllis Y. Price

[57] ABSTRACT

In a CT imaging system which includes a gantry having a rotatable ring member and a DAS comprising circuit boards grouped in a selected number of sets, a DAS housing is provided which is disposed to dissipate heat away from the DAS circuit boards. The housing includes a frame for mounting each of the circuit boards on the gantry ring so that the boards of a set are in spaced-apart relationship with each other, and further includes a cover for each frame, to form an enclosure for the circuit boards supported thereby. Each cover is provided with a panel member, a section of each panel being provided with a specified pattern of perforations. Each panel is positioned with respect to its set of circuit boards to provide an unobstructed space of selected dimension between its pattern of perforations and its corresponding circuit board set.

12 Claims, 4 Drawing Sheets

DAS HOUSING WITH ENHANCED HEAT TRANSFER CAPABILITY FOR CT IMAGING SYSTEM

BACKGROUND OF THE INVENTION

The invention disclosed and claimed herein generally pertains to a cover or housing for a data acquisition system (DAS) of a computed tomography (CT) imaging system, wherein the housing is configured to allow heat to be readily transferred away from the DAS. More particularly, the invention pertains to a housing of such type which enhances or facilitates air flow, in order to carry heat away from the DAS and thereby significantly reduce image artifacts.

In a CT imaging system or scanner, a gantry rotates an X-ray tube around a patient or other object of scanning. X-radiation projected by the tube, which is not absorbed by intervening patient body structure, is sensed by respective detectors of a detector array. In certain classes of CT products, such as those manufactured by the General Electric Company, the assignee herein, the array comprises solid state detectors which generate electric signals corresponding to the sensed radiation. The signals are coupled to a data acquisition system or DAS, and data acquired thereby is in turn coupled to an image processor, which reconstructs an image of the body structure or other object of interest.

It is intended that images generated by a CT scanner, both of anatomy and of phantoms, be free and clear of any artifacts. Some of the most commonly seen artifacts are rings and bands. These artifacts are not desirable, as they can lead to misdiagnosis by a radiologist. Artifacts can occur due to the malfunction of any one of the sub-systems in the image chain, such as the X-ray tube, detector, DAS or image processing software. However, in the CT product classes referred to above, recently acquired field data has demonstrated that the proportion of artifacts which are specifically caused by malfunction of the DAS may exceed 25 percent. Moreover, it has been suspected that a significant number of other artifacts, for which the cause is not definitely known, may in fact be due to defects in the DAS.

In the above CT product classes, the DAS typically comprises a large number of printed circuit boards, which are electrically coupled together. Those of skill in the art have recognized that a DAS of this type is extremely sensitive. In particular, it has been commonly believed that DAS operation is likely to be disturbed by sudden changes in temperature. Accordingly, current standard practice is to place the DAS within a substantially air-tight enclosure, to enhance temperature stability. In some arrangements, each DAS board is also sealed individually, within its own air-tight compartment. However, notwithstanding such measures, DAS malfunctions continue to cause a significant portion of CT system artifacts, as indicated by the percentage figures set forth above.

In making the invention, it was determined that sealing a DAS of the above type in a substantially air-tight enclosure, as taught by the prior art, had significant drawbacks. More particularly, it was recognized that, while the amount of heat generated by the DAS circuit boards is comparatively negligible, such enclosures tended to retain the heat in close proximity to the DAS. Moreover, the DAS boards continuously receive electric power, and therefore are always generating heat. This results from the conventional practice of keeping a CT system powered up at all times, even when the system is idle, i.e., is not being operated to perform scanning operations.

Through extensive investigation and analysis, the inventor has now determined that under certain circumstances, and during idle periods which are prolonged, the heat retained in a DAS can become significant. Moreover, such heat can degrade DAS performance and be a principal cause of artifacts. More specifically, it has been found that if a CT system is idle for a substantial period, such as at night or over a weekend, and if the system is not well ventilated, the temperature within a conventional DAS enclosure may exceed 60° C. At the same time, the temperature within the surrounding gantry enclosure may be on the order of 30°–35° C. This differential can create certain problems which are considered to have been overlooked, prior to the inventor's recognition thereof. Specifically, when the CT system is placed into operation, the DAS will rotate with the gantry. Initially, rotation will cause the cooler air of the gantry enclosure to draw heat away from the DAS, and the temperature thereof steadily drops. Eventually, DAS temperature will stabilize at the gantry enclosure temperature. However, calibration of the CT system, which must be performed at the beginning of a scan operation, may take place before DAS temperature stabilizes. Because of the extreme sensitivity of the DAS to temperature change, as noted above, the calibration may not be valid when the DAS stabilizes. It is believed that in the past, this situation has resulted in significant artifacts, while the cause thereof was not understood.

SUMMARY OF THE INVENTION

In accordance with these conclusions, and in order to significantly reduce DAS-originating artifacts, the present invention is generally directed to a housing for the DAS of a CT imaging system, wherein the DAS comprises circuit boards grouped in a selected number of sets. The housing comprises means for mounting each of the circuit boards on a rotatable member of the imaging system gantry, so that the boards of a set are in spaced-apart relationship with one another. The housing further comprises a panel corresponding to each of the circuit board sets, a section of each panel being provided with a specified pattern of perforations. Means are also provided for attaching each of the panels to the mounting means, so that each panel is in fixed relationship with the circuit boards of its corresponding set. A given panel is positioned to provide an unobstructed space of selected dimensions between its pattern of perforations and its respective corresponding circuit boards. It is anticipated that the housing of the invention will prevent extreme temperature differentials, as described above, from developing between the DAS and gantry enclosures.

In a preferred embodiment, the CT imaging system includes gantry shielding structure, which is positioned around the gantry to form an enclosure. The DAS housing is located within the gantry enclosure, and substantially encloses a selected space proximate to the DAS, which includes the unobstructed space referred to above. The panel perforation patterns are respectively configured to enable substantially unrestricted airflow between the enclosed selected DAS space and the gantry enclosure. As a result, heat is readily removed from the space around the DAS boards, particularly when the gantry is rotated in the course of a scanning operation. Preferably, the circuit boards of the set corresponding to the given panel each has a selected edge lying in a common plane, and the selected edges together define a rectangular-shaped area in the plane. The given panel has a perforation pattern which defines an area substantially identical to the rectangular area, and positioned in spaced-apart parallel relationship therewith. Preferably also, means are joined to each panel for holding the circuit boards of its corresponding set firmly in place during gantry rotations.

OBJECTS OF THE INVENTION

An object of the invention is to significantly reduce artifacts in a CT imaging system which are caused by malfunction of a DAS comprising an array of circuit boards.

Another object is to protect the respective circuit boards of the DAS from disturbance by debris or other foreign objects or matter, and at the same time allow heat generated by the DAS to be readily dissipated away therefrom.

Another object is to enhance airflow between space proximate to the DAS and a surrounding or adjacent gantry enclosure.

Another object is to insure that respective circuit boards are retained firmly in place on their mounting frame, as the DAS rotates with the gantry ring.

These and other objects of the invention will become more readily apparent from the ensuing specification, taken together with the accompanying drawings.

DETAILED DESCRIPTION OF THE PREFERRED EMBODIMENT

Figure 1:
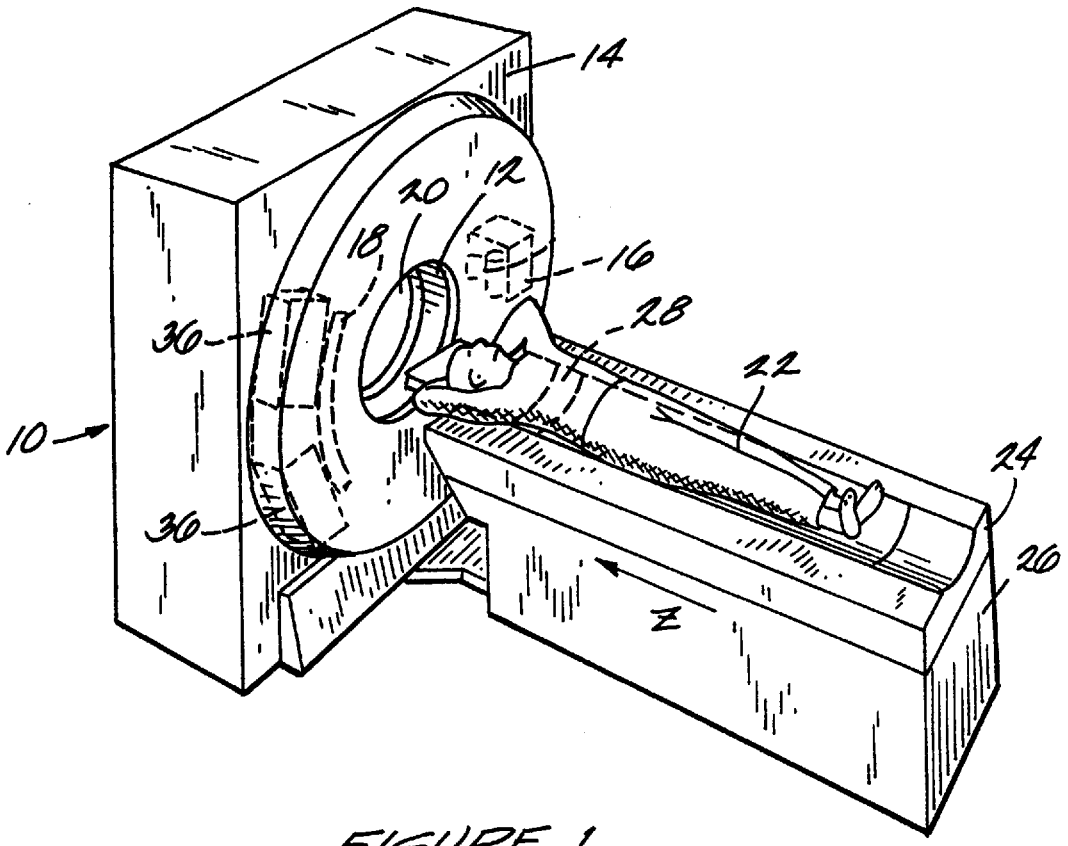
FIG. 1 is a perspective view showing a generalized CT imaging system.

Referring to FIG. 1, there is shown a CT system 10 which includes a gantry frame (shown in FIG. 2) and an annular gantry member or gantry ring 12 which is journaled on the frame, or mounted for rotation, by means of suitable bearings (not shown). The gantry frame and rotatable gantry ring 12 are contained within a shroud or gantry shielding structure 14.

Referring further to FIG. 1, there is shown an X-ray tube 16 and an X-ray detector 18 mounted on the rotatable gantry member 12 for rotation therewith, on opposing sides of a bore 20. A patient 22, positioned on a patient support 24, can be moved along the axis of bore 20 by sliding the support 24 along the direction shown in FIG. 1 by the arrow Z, relative to a base 26. A region or section 28 of the patient 22 may thereby be positioned within the bore 20. Thereupon, gantry member 12 is driven to rotate tube 16 and detector 18 to acquire CT scan data of the patient section 28, in accordance with conventional practice. The data is then employed to construct an image of the scanned section, likewise in accordance with conventional techniques.

Figure 2:
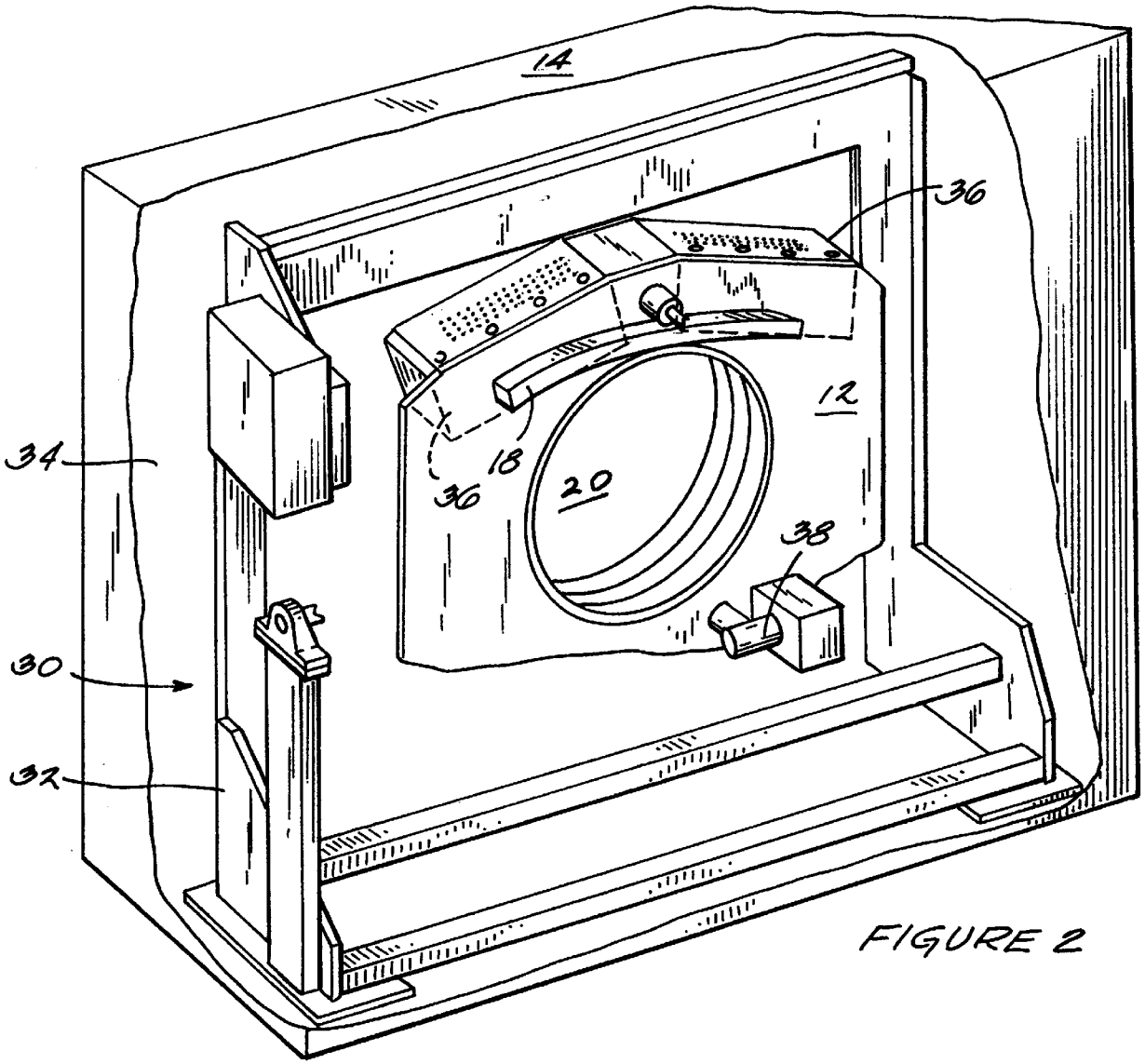
FIG. 2 is a perspective view showing the system of FIG. 1, wherein the gantry shielding has been partly removed to reveal certain system components including the gantry and a DAS provided with an embodiment of the invention.

Referring to FIG. 2, there is shown gantry 30, including rotatable member 12 and gantry frame 32, positioned within an enclosure 34 formed by the shielding 14. FIG. 2 further shows a DAS 36 mounted on rotatable member 12, in adjacent relationship with detector 18. Detector 18, comprising an array of solid state detector cells, usefully comprises a product of assignee General Electric Company, which is known commercially as the HiLight CT detector. As is well known in the art, and as stated above, the DAS 36 receives electric signals from corresponding detector cells, wherein the signals represent radiation sensed by respective cells of detector 18. The DAS processes the electric signals, in accordance with techniques well known in the art, to enable the signals to be used by a system image processor (not shown) to construct a desired CT image. Accordingly, the DAS 36 is a critical component of the CT system 10.

FIG. 2 further shows a motor 38 which may be activated to rotate member 12 and components mounted thereon. A number of other conventional CT components which are mounted on rotatable member 12, or which otherwise reside within gantry enclosure 34, are not necessary for illustrating or understanding the invention, and, accordingly, are not shown.

Figure 3:
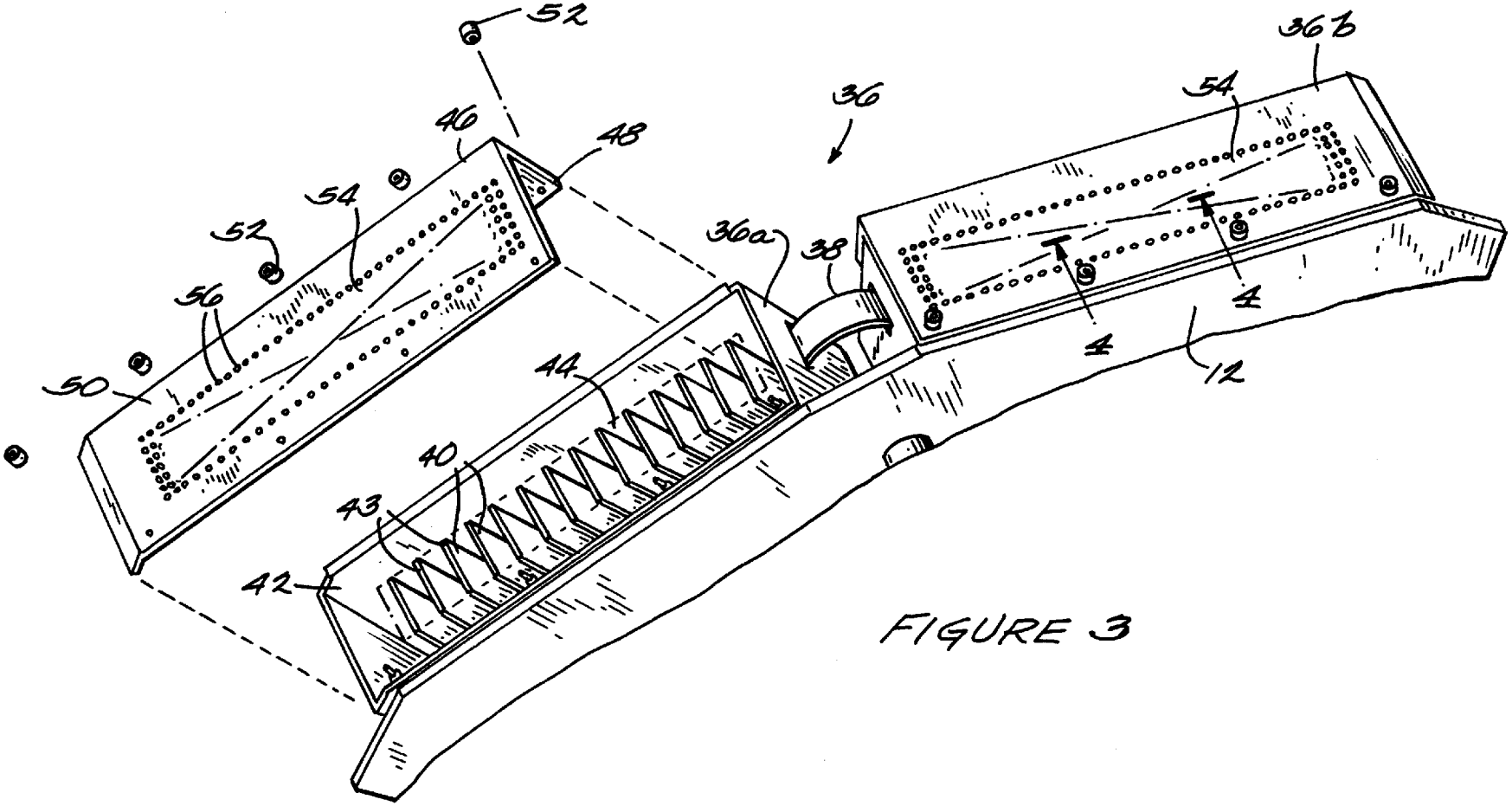
FIG. 3 is a perspective view showing the DAS and embodiment of FIG. 2 in greater detail.

Referring to FIG. 3, there is shown DAS 36 comprising two DAS components 36*a* and 36*b*, electrically connected by means of a cable or ribbon connector 38. (Detector 18 has been deleted from FIG. 3 for simplification.) Each DAS component comprises a set of printed circuit boards 40, such as on the order of 46–47 circuit boards, and further comprises a frame 42 mounted on rotatable gantry member 12. Each frame supports its corresponding circuit boards 40 in spaced-apart parallel relationship, so that each of the edges 43 of the circuit boards 40 lie in a common plane. Respective edges 43 are oriented radially outward, with respect to circular bore 20 surrounded by rotatable member 12. Moreover, the circuit board edges 43 of each DAS component collectively define a rectangular area which lies in the corresponding common plane, such as an area 44 shown in FIG. 3.

Referring further to FIG. 3, there is shown each DAS component provided with a cover 46, which is constructed for placement on the corresponding circuit board frame 42. Each cover comprises a flange bracket member 48 and a flat panel member 50. The bracket member 48, together with nuts 52, serves to hold the panel 50 in place, in spaced apart relationship from the edges 43 of its circuit boards 40. Accordingly, the cover 46 and frame 42 together form an enclosure for circuit boards 40, which serves to protect the circuit boards from unintended contact by a system operator or other person, as well as from debris or other foreign materials within the gantry enclosure. Moreover, the cover may be readily adapted to firmly hold the circuit boards tightly against the frame 42, as described in further detail in connection with FIGS. 5 and 6.

Figure 4:
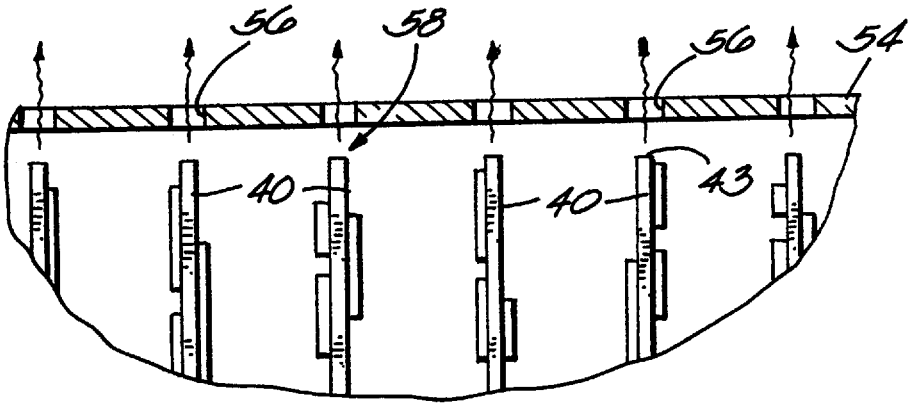
FIG. 4 is a sectional view taken along lines 4—4 of FIG. 3.

FIG. 3 further shows each panel 50 having a section 54 provided with a pattern of holes or perforations 56. Each section 54 has an area which is substantially identical to the rectangular area 44 defined by respective edges of the circuit boards corresponding thereto. That is, the area of section 54 is mapped to the area 44. When a cover 46 is in place on a frame 42, the section 54 is positioned in spaced-apart parallel relationship with the area 44, whereby an unobstructed space 58 is provided between respective circuit boards and the perforations 56, as best shown by FIG. 4. Accordingly, air can readily flow from gaps between the circuit boards and out of the DAS enclosure formed by cover 46 and frame 42, into the surrounding gantry space. Such airflow is significantly enhanced by rotation of gantry member 12. The moving air readily removes heat generated by application of electric power to the circuit boards, during both scanning operations and system idle periods. As has been stated above, the removal of heat has been found to significantly reduce DAS-originating image artifacts. In particular, removal of heat prevents the aforesaid temperature differential from developing between locations in the DAS and gantry enclosures. Moreover, the possibility of DAS boards being damaged by heat is reduced.

Preferably, the perforation patterns of respective sections 54 comprise a number of circular holes, which are packed or closely spaced together. The diameter of the holes 56 is usefully on the order 3.5–4.0 times the minimum spacing between adjacent holes.

Figure 5:
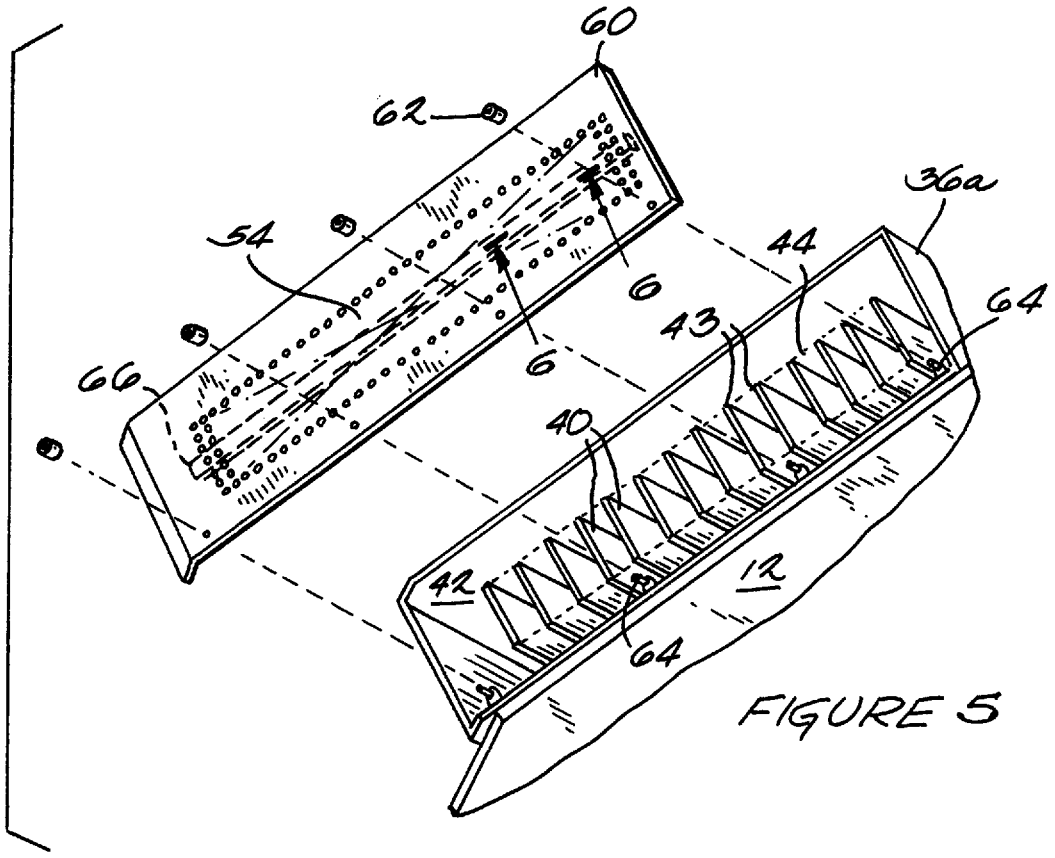
FIG. 5 is a perspective view showing a modification of the invention.

Referring to FIG. 5, there is shown a modified cover 60 for enclosing DAS circuit boards 40 mounted on a frame 42. Cover 60 does not have a bracket member 48. Instead, cover 60 is held in place exclusively by fasteners such as nuts 62, engaging screws 64 or the like.

Figure 6:
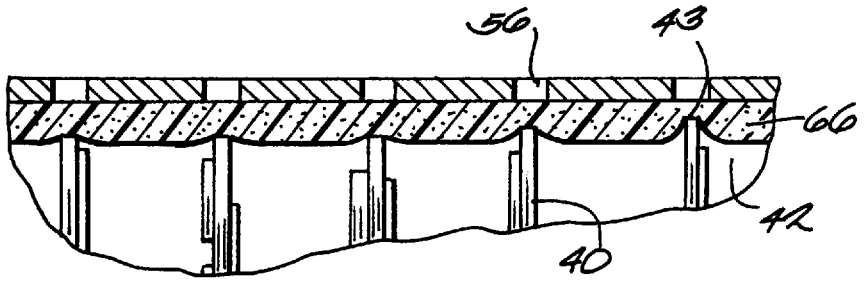
FIG. 6 is a sectional view taken along lines 6—6 of FIG. 5.

Referring further to FIG. 5, there is shown a strip of foam material 66 attached to the underside of cover 60, as viewed in FIG. 5. When cover 60 is secured to the frame 42, the strip 66 acts against respective edges 43 of circuit boards 40 to tightly hold the boards in place with respect to the frame 42. This is best shown in FIG. 6. By the simple provision of strips 66, the DAS boards will remain secured notwithstanding the rotational force of gantry ring 12. While the retention strip 66 blocks some of the holes of pattern 54, the effect on air flow will not be significant.

Obviously, many modifications and variations of the present invention are possible in light of the above teachings. It is therefore understood that within the scope of the disclosed inventive concept, the invention may be practiced otherwise than as specifically described.

What is claimed is:

1. In a CT imaging system which includes a gantry having a rotatable ring member and further includes a data acquisition system comprising circuit boards grouped in a selected number of sets, a housing for the data acquisition system comprising:

means for mounting each of said circuit boards on said rotatable ring member so that the boards of a set are in spaced-apart relationship with each other;

a panel corresponding to each of said circuit board sets, a section of each panel being provided with a specified pattern of perforations;

means for attaching each of said panels to said mounting means so that each panel is in fixed relationship with the circuit boards of its corresponding set, a given one of said panels being positioned to provide an unobstructed space of selected dimension between its pattern of perforations and its respective corresponding circuit boards; and said data acquisition system comprises a plurality of circuit board sets, which are mounted on said ring member in adjacent relationship.

2. The housing of claim 1 wherein:

said housing includes means for retaining respective circuit boards of said data acquisition system firmly in position on said mounting means, as said ring member rotates.

3. The housing of claim 2 wherein:

the circuit boards of the set corresponding to said given panel are in spaced-apart parallel relationship with each other, and each has a selected edge lying in a common plane; and said given panel is fixed in substantially parallel relationship to said common plane.

4. The housing of claim 3 wherein:

said selected circuit board edges collectively define a rectangular-shaped area lying in said common plane; and said perforation pattern of said given panel defines an area which is substantially identical to said rectangular shaped area, and is positioned in spaced-apart parallel relationship therewith.

5. Apparatus for a CT imaging system which includes a gantry having a rotatable member, and further includes a data acquisition system comprising circuit boards grouped in a selected number of sets, said apparatus comprising:

a gantry shielding structure positioned to form a gantry enclosure around said gantry;

means for mounting each of said circuit boards on said rotatable gantry member so that the boards of a set are in spaced-apart relationship with each other;

a panel corresponding to each of said circuit board sets;

means for attaching each of said panels to said mounting means so that each panel is in fixed relationship with the circuit boards of its corresponding set, said attaching means, said mounting means, and said panels collectively forming a data acquisition system enclosure which is positioned around said data acquisition system, and is located within said gantry enclosure; and each of said panels has a section provided with an array of closely spaced perforations formed therethrough to enable substantially unrestricted airflow between said data acquisition system enclosure and said gantry enclosure, the perforation array formed through the section of a given one of said panels defining a selected geometric pattern which substantially covers the area of said section of said given panel.

6. The apparatus of claim 5 wherein:

said perforation array formed through said section of said given panel comprises a matrix array defining a rectangular pattern.

7. The apparatus of claim 6 wherein:

said perforations respectively comprise circular holes, the diameter of said holes being on the order of four times the minimum spacing between adjacent holes of said arrays.

8. The apparatus of claim 6 wherein:

said attaching means comprises means for attaching said given panel to said mounting means so that said given panel is positioned to provide an unobstructed space of selected dimension between its array of perforations and its respective corresponding circuit boards.

9. The apparatus of claim 8 wherein:

the circuit boards of the set corresponding to said given panel are in spaced-apart parallel relationship with each other, and each has a selected edge lying in a common plane; and said given panel is fixed in substantially parallel relationship to said common plane.

10. The apparatus of claim 9 wherein:

said selected circuit board edges collectively define a rectangular-shaped area lying in said common plane which is substantially identical to said rectangular pattern defined by said perforation array of said given panel, and is positioned in spaced-apart parallel relationship therewith.

11. The apparatus of claim 6, wherein said apparatus further comprises:

a frame joined to said gantry member for supportably mounting each of said circuit boards in spaced-apart relationship with each other; and means for retaining said circuit boards of said data acquisition system firmly in position on said frame as said gantry member rotates.

12. The housing of claim 11 wherein:

the circuit board retaining means associated with said given panel comprises a strip of compliant material attached to the side of said given panel which is adjacent to said circuit board selected edges, said compliant strip acting against said selected edges to hold the respective circuit boards thereof firmly in place on said frame, when said given panel is attached to said frame.

* * * * *